US009460843B2

(12) United States Patent
Hayashi et al.

(10) Patent No.: US 9,460,843 B2
(45) Date of Patent: Oct. 4, 2016

(54) ELECTRONIC COMPONENT

(71) Applicant: TAIYO YUDEN CO., LTD., Taito-ku, Tokyo (JP)

(72) Inventors: Masahiro Hayashi, Takasaki (JP); Hideki Ogawa, Takasaki (JP); Keizo Kawamura, Takasaki (JP); Toshiyuki Yagasaki, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 114 days.

(21) Appl. No.: 14/446,245

(22) Filed: Jul. 29, 2014

(65) Prior Publication Data

US 2015/0035635 A1 Feb. 5, 2015

(30) Foreign Application Priority Data

Jul. 31, 2013 (JP) ..... 2013-159977

(51) Int. Cl.

| | |
|---|---|
| ***H01F 27/29*** | (2006.01) |
| ***H01F 27/28*** | (2006.01) |
| ***H01F 27/24*** | (2006.01) |
| ***H01F 27/02*** | (2006.01) |
| ***H01F 27/255*** | (2006.01) |
| ***H01F 17/04*** | (2006.01) |

(52) U.S. Cl.

CPC ..... *H01F 27/255* (2013.01); *H01F 17/045* (2013.01)

(58) Field of Classification Search

CPC ..... H01F 5/04; H01F 27/292; H01F 41/10; H01F 27/29; H01F 27/027; H01F 17/045; H01F 41/0666; H01F 27/263; H01F 27/255

USPC ..... 336/192, 232, 233

See application file for complete search history.

(56) References Cited

U.S. PATENT DOCUMENTS

| | | | | |
|---|---|---|---|---|
| 6,515,566 | B1 * | 2/2003 | Toi | H01F 27/292 336/185 |
| 7,477,122 | B2 * | 1/2009 | Iguchi | H01F 17/045 336/192 |
| 7,786,838 | B2 * | 8/2010 | Nakada | H01F 1/344 29/602.1 |
| 2002/0021199 | A1 * | 2/2002 | Serino | G01L 3/101 336/84 M |
| 2007/0146110 | A1 * | 6/2007 | Oki | H01F 17/045 336/232 |
| 2007/0159282 | A1 * | 7/2007 | Huang | H01F 27/255 336/83 |
| 2009/0212894 | A1 * | 8/2009 | Hsieh | H01F 17/045 336/83 |
| 2010/0148902 | A1 * | 6/2010 | Shin | H01F 17/045 336/90 |
| 2011/0006870 | A1 * | 1/2011 | Sakamoto | H01F 1/26 336/221 |
| 2011/0227690 | A1 * | 9/2011 | Watanabe | C22C 38/00 336/221 |
| 2012/0140374 | A1 * | 6/2012 | Kawasaki | H01G 4/008 361/301.3 |
| 2012/0146759 | A1 * | 6/2012 | Shibuya | H01F 17/043 336/221 |
| 2012/0274438 | A1 * | 11/2012 | Hachiya | H01F 17/0013 336/221 |
| 2013/0200972 | A1 | 8/2013 | Wada et al. | |

FOREIGN PATENT DOCUMENTS

JP 2013045927 A 3/2013

* cited by examiner

*Primary Examiner* — Mangtin Lian
*Assistant Examiner* — Kazi Hossain
(74) *Attorney, Agent, or Firm* — Law Office of Katsuhiro Arai

(57) ABSTRACT

Provided is an electronic component having a core that can achieve size reduction and frequency increase by improving the magnetic permeability further while also improving the plating property for the terminal electrode. An electronic component has a shaft, a flange formed at an end of the shaft and constituting a core together with the shaft, a coiled conductor wound around the shaft, and an electrode terminal formed on the flange and connected electrically to an end of the conductor; wherein the shaft and flange are made of a metal magnetic material, and the shaft is more densely filled with the metal magnetic material than is the flange.

10 Claims, 5 Drawing Sheets

ELECTRONIC COMPONENT

FIELD OF THE INVENTION

The present invention relates to an electronic component such as a so-called inductance component which has a core and a coiled conductor wound around the shaft of the core.

DESCRIPTION OF THE RELATED ART

Inductances, choke coils, transformers, and other coil components (so-called "inductance components") have a magnetic material and a coil formed inside or on the surface of the magnetic material. Representative coil components used for power supplies include those comprising a magnetic body and a coil wound around it, as this constitution is associated with good current characteristics. In particular, a metal magnetic material is used in cases where saturation characteristics are important. As devices offering higher performance become available, coil components characterized not only by good current characteristics, but also by a smaller size and higher frequency, are needed.

For example, Patent Literature 1 discloses a compact electronic component offering improved electrical characteristics and reliability while allowing for high-density mounting and low-height mounting on a circuit board in a favorable manner, wherein such electronic component has a sheathed conductive wire wound around a base material as well an exterior resin part which is made of resin material including filler and which covers the outer periphery of the sheathed conductive wire.

BACKGROUND ART LITERATURES

[Patent Literature 1] Japanese Patent Laid-open No. 2013-45927

SUMMARY

Here, simply reducing the size of the coil component results in a reduced thickness of the magnetic body covering the coil. This may cause the effective magnetic permeability to drop. On the other hand, supporting a higher frequency range may require that the insulation property be increased to suppress the loss of magnetic material or that a magnetic material of smaller grain size be used. However, both of these measures have a drawback of reducing the magnetic permeability of the material. It is therefore necessary, when pursuing size reduction or frequency increase, to make up for the resulting lower effective magnetic permeability or lower magnetic permeability of the material.

Another problem is plating elongation that occurs when the terminal electrode is directly connected to the core for the purpose of size reduction. Plating elongation results from using a magnetic material having a higher fill ratio and/or smaller grain size and consequently becoming a lower roughness (smaller interval between grains) on the surface of the magnetic body. Accordingly, a core of high fill ratio that does not cause plating elongation is needed to achieve size reduction and frequency increase.

In consideration of the above, the object of the present invention is to provide an electronic component having a core that can achieve size reduction and frequency increase.

After studying in earnest, the inventors of the present invention completed the present invention as described below:

(1) An electronic component comprising a shaft, a flange formed at an end of the shaft and constituting a core together with the shaft, a coiled conductor wound around the shaft, and an electrode terminal formed on the flange and connected electrically to an end of the conductor; wherein the shaft and flange are made of a metal magnetic material, and the shaft is more densely filled with the metal magnetic material than is the flange.

(2) An electronic component according to (1), wherein a/b, where a represents the fill ratio of metal magnetic material of the flange and b represents the fill ratio of metal magnetic material of the shaft, is 0.9 to 0.97.

(3) An electronic component according to (1) or (2), wherein the core is either a drum core or T core.

(4) An electronic component according to any one of (1) through (3), wherein the metal magnetic material is constituted by an aggregate of many alloy magnetic grains and adjacent alloy magnetic grains are aggregated with each another primarily by means of inter-bonding of oxide films formed near the surfaces of the grains. In this disclosure, the term "constituted by" refers to "comprising", "consisting essentially of", or "consisting of", depending on the embodiment.

(5) An electronic component according to any one of (1) through (4), wherein an exterior member is further provided on the outside of the coiled conductor, the exterior member contains an organic resin and metal magnetic material, and the metal magnetic material contained in the exterior member may be the same as or different from the metal magnetic material constituting the shaft and flange.

(6) An electronic component according to any one of (1) through (5), wherein the electrode terminal contains Ag, Ni, and Sn.

According to the present invention, an electronic component offering high magnetic permeability as well as good plating property for its terminal electrode is provided. To be specific, plating elongation no longer occurs, even when a metal magnetic material is used, and therefore electrodes can be formed in a manner directly connected to the core and consequently a component characterized by large current, small size and low height can be obtained. In a favorable embodiment, oxide film is formed on the surfaces of alloy magnetic grains to interconnect the grains and thereby achieve core strength. Accordingly, the necessary frequency can be supported regardless of the grain size of the alloy magnetic material. In particular, use of an alloy magnetic material of smaller grain size will support the need for higher frequency in the future.

Any discussion of problems and solutions involved in the related art has been included in this disclosure solely for the purposes of providing a context for the present invention, and should not be taken as an admission that any or all of the discussion were known at the time the invention was made.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features, and advantages of this invention will become apparent from the detailed description which follows.

[Description of the Symbols]

11: Shaft, 12: Flange, 51, 52: Die, 53, 54: Punch

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

DETAILED DESCRIPTION OF EMBODIMENTS

Figure 1:
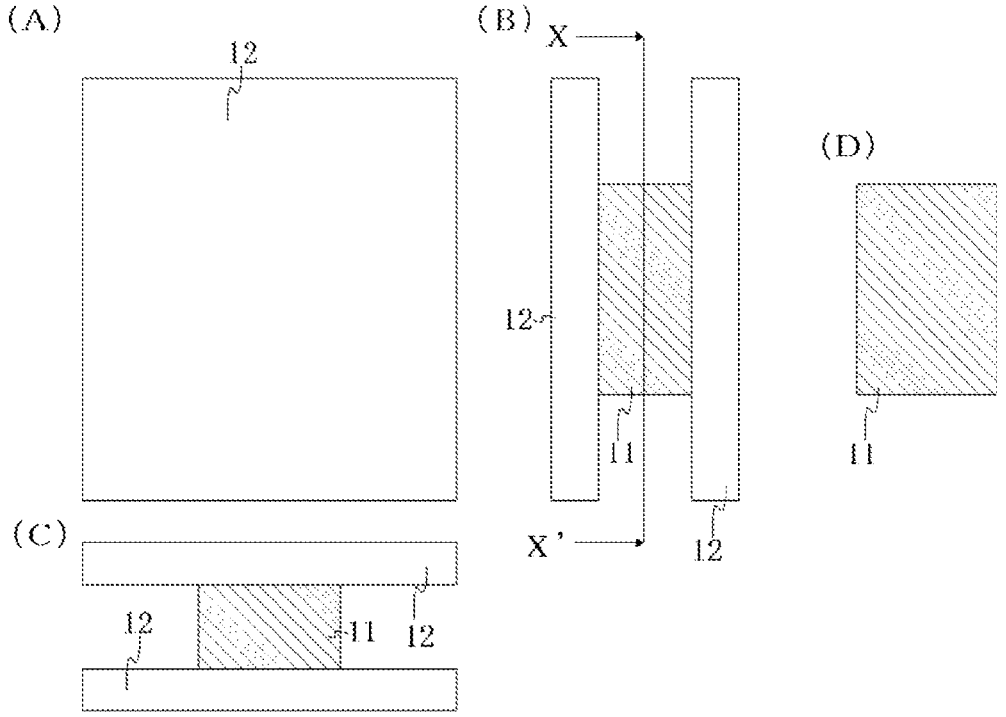
FIG. 1 is a schematic drawing of a core in an embodiment of the present invention, consisting of (A) a plan view, (B) a side view, (C) another side view, and (D) a section view taken along line X-X'.

The present invention is described in detail by referring to the drawings as deemed appropriate. It should be noted, however, that the present invention is not limited in any way to the illustrated embodiments and that the scale of each part in the drawings is not necessarily accurate because a characteristic part or parts of the invention may be emphasized in the drawings.

The electronic component proposed by the present invention has a core and a coiled conductor wound around the shaft of the core and is normally called an "inductance component" or "coil component."

FIG. 1 is a schematic drawing of a core in an embodiment of the present invention. (A) in FIG. 1 is a plan view, (B) and (C) in FIG. 1 are side views, and (D) in FIG. 1 is a section view (view of section X-X') of a shaft. The core has a shaft 11 and a flange 12. The shape of the shaft 11 is not limited in any way so long as there is an area for winding a coiled conductor (not illustrated), but a solid shape with its long axis extending in one direction, such as cylinder or prism, is preferred. The flange 12 is shaped differently from the shaft 11 and formed at least on one end of the shaft 11, but preferably one flange is formed on each of the two ends of the shaft 11, as shown in the figure. At least one flange 12 is provided with an electrode terminal (not illustrated). The electrode terminal is electrically connected to an end of the coiled conductor described later, and normally the outside of the component proposed by the present invention is made electrically continuous with the aforementioned coiled conductor via the electrode terminal.

Figure 2:
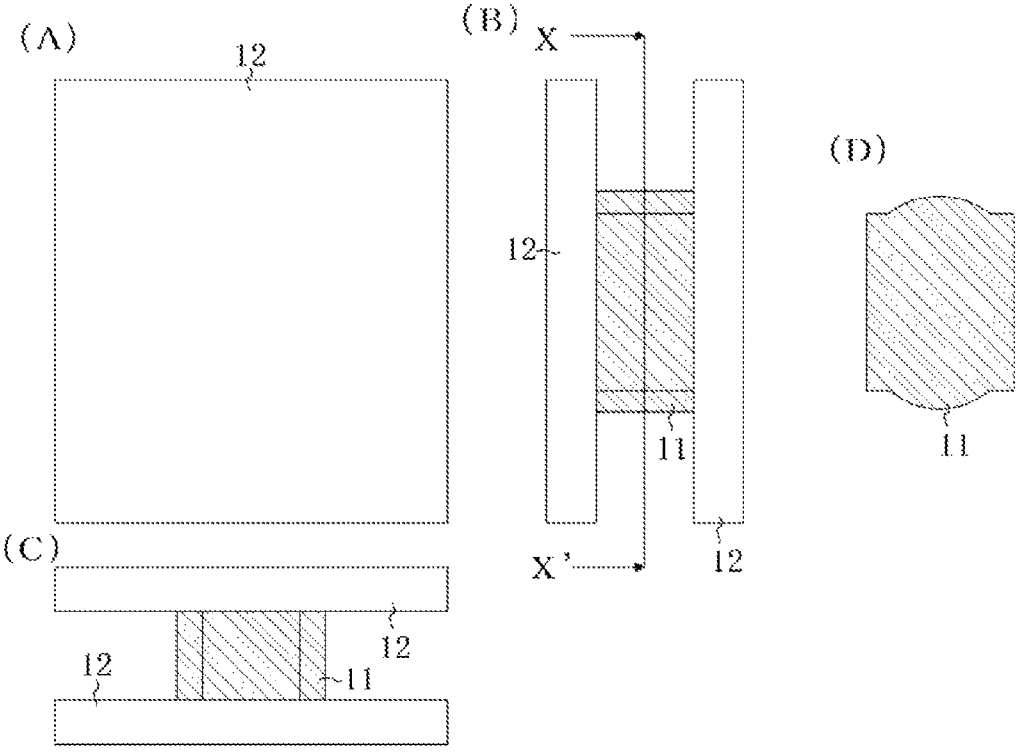
FIG. 2 is a schematic drawing of a core in an embodiment of the present invention, consisting of (A) a plan view, (B) a side view, (C) another side view, and (D) a section view taken along line X-X'.
Figure 3:
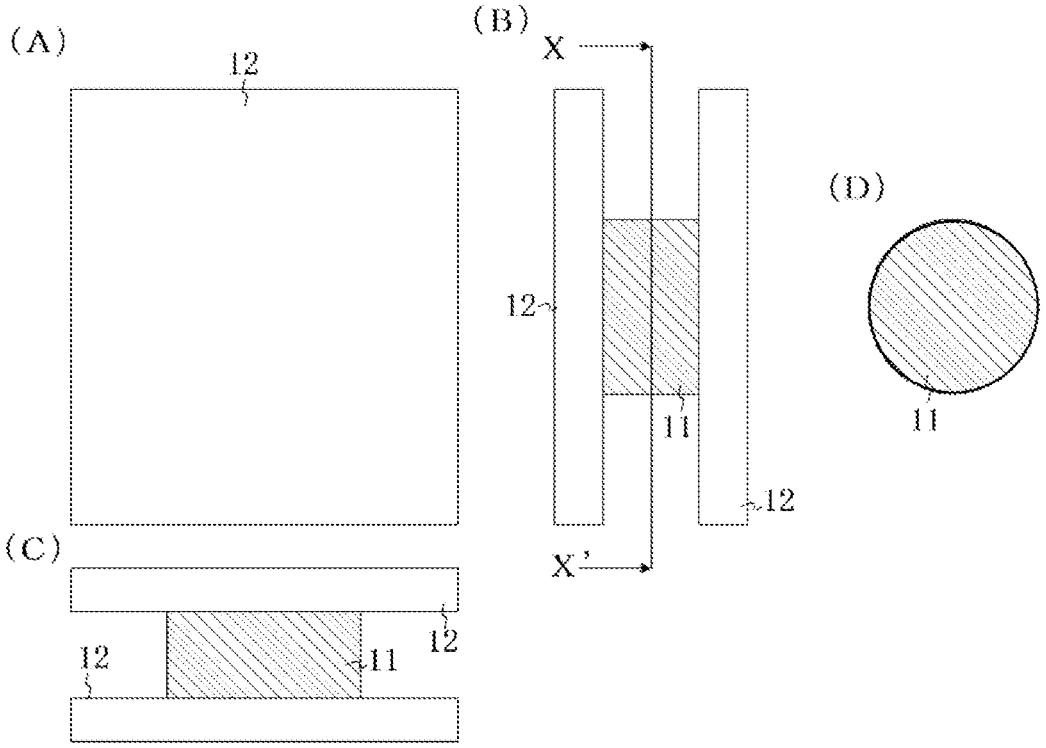
FIG. 3 is a schematic drawing of a core in an embodiment of the present invention, consisting of (A) a plan view, (B) a side view, (C) another side view, and (D) a section view taken along line X-X'.

FIGS. 2 and 3 are also each a schematic drawing of a core in an embodiment of the present invention. In these drawings, (A) through (D) have the same meanings as the corresponding symbols in FIG. 1. In the embodiment shown in FIG. 2, the shaft 11 has a structure that becomes wider at the center of the long axis. In the embodiment shown in FIG. 3, the shaft 11 is a cylinder. Preferably the core takes the form of a so-called "T core" having a flange only on one end of its columnar shaft, or "drum core" having flanges on both ends of its columnar shaft, because such core, in the aforementioned embodiment, makes it easy to manufacture a thin core having a thin flange 12, which is advantageous in terms of lowering the height. Besides the above, any prior art can be applied as deemed appropriate to achieve a specific shape of the core.

The shaft 11 and flange 12 are made of a metal magnetic material. A metal magnetic material is constituted in such a way that magnetism is expressed in non-oxidized metal parts, and may be a compact comprising non-oxidized metal grains and alloy grains with an oxide, etc., provided around them for the purpose of insulation as deemed appropriate. The metal magnetic material of the shaft 11 may be the same as or different from the metal magnetic material of the flange 12. Preferably the metal magnetic material is a compact constituted by an aggregate of insulated non-oxidized alloy grains, and the details of such compact are explained later.

Here, the fill ratio of metal magnetic material of the flange 12 is given by a, while the fill ratio of metal magnetic material of the shaft 11 is given by b. According to the present invention, $a/b < 1$ holds, which means that the shaft 11 is more densely packed with the metal magnetic material than is the flange 12. Preferably a/b is 0.9 to 0.97. When a/b is in this range, high inductance can be achieved simultaneously with good plating property for the flange 12. To be more specific, keeping the fill ratio of metal magnetic material relatively lower at the flange 12 allows for good formation of plating when the electrode terminal is formed. On the other hand, the overall inductance of the electronic component can be improved by densely packing the metal magnetic material at the shaft 11. The fill ratio refers to a ratio of (volume of shaft or flange material)/(apparent volume of shaft or flange). Here, if the shaft 11 and flange 12 are constituted by the same metal magnetic material, then the density of each part ($g/cm^3$) corresponds to the fill ratio of each.

As mentioned earlier, it has been extremely difficult with a conventional ferrite material core to adjust the fill ratios of the shaft 11 and flange 12. This is because, according to the conventional method of using ferrite and varying the fill ratio of each part in the core, each part would contract differently when heat treatment is applied, causing deformation, cracks, etc. In particular, a core with a thin flange would present problems such as deformation of the flange. Accordingly, adjusting the fill ratio has not been possible if ferrite was used. Use of an alloy magnetic material subject to less contraction under heat treatment makes this adjustment possible for the first time. In addition, ferrite deforms easily due to contraction when sintered, and particularly with a thin core, lower strength or poorer dimensional accuracy has been reported as a result of deformation. When an alloy magnetic material is used, on the other hand, contraction and deformation resulting therefrom can be kept to a minimum by heat-treating the material to an extent not causing sintering. As a result, a core with a thin flange of 0.25 mm or less in thickness can be obtained, for example. In addition, the core can be impregnated with resin as necessary, because it increases strength and adds to impact resistance. Preferably the shaft 11 and flange 12 are formed and then given heat treatment simultaneously.

Figure 4:
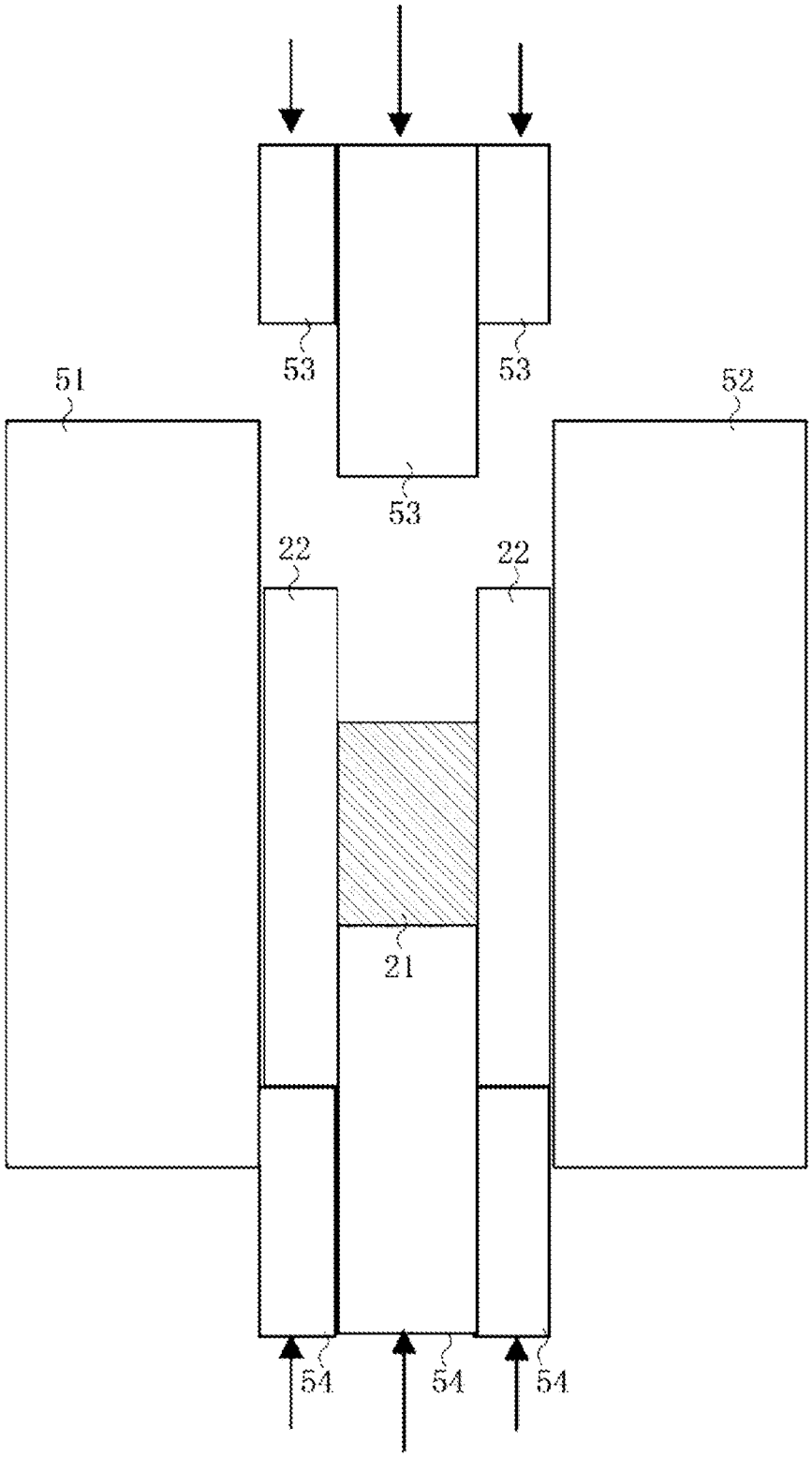
FIG. 4 is a drawing explaining how a core is manufactured in an embodiment of the present invention.

One way to change the fill ratio of metal magnetic material between the shaft 11 and flange 12, as mentioned above, is to shape the core in the forming process. Under this method, the core is formed using dies that have been divided to correspond to the shaft 11 and to the flange 12, respectively. FIG. 4 is a schematic drawing explaining this method. It depicts how material powder is compacted to shape the core. An area 21 corresponding to the shaft and an area 22 corresponding to the flange are formed by compacting using dies 51, 52 and punches 53, 54 to make the core shape. At this time, the amount of alloy magnetic grains used for the area 21 corresponding to the shaft and area 22 corresponding to the flange, and how much they are compacted, are adjusted to adjust the fill ratio of the shaft 11 and that of the flange 12.

Figure 5:
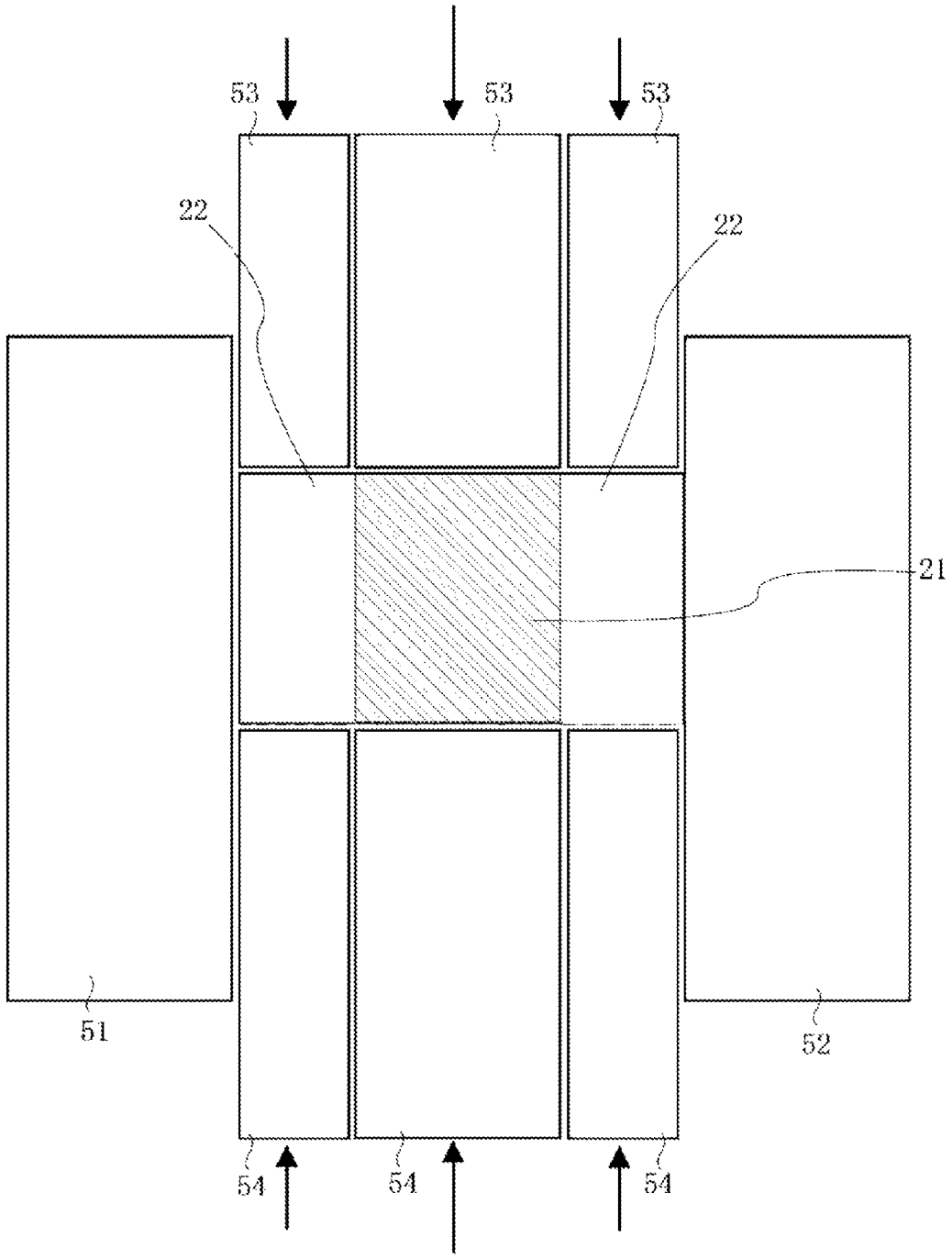
FIG. 5 is a drawing explaining how a core is manufactured in another embodiment of the present invention.

Another method is to shape the core by grinding the formed core. Under this method, too, dies that have been divided to correspond to the shaft and flange of the core, respectively, are used in the forming process. Thereafter, the wound area is ground to obtain the necessary core shape. FIG. 5 is a schematic drawing explaining this method. It depicts how alloy magnetic grain powder is compacted to shape the core. The area 21 corresponding to the shaft and area 22 corresponding to the flange are formed by compacting using dies 51, 52 and punches 53, 54. This process does not need to make the core shape, and the powder may be compacted to a cylinder or other simple shape, for example. At this time, the amount of alloy magnetic grains used for the area 21 corresponding to the shaft and area 22 corresponding to the flange, and how much they are compacted, are adjusted to adjust the fill ratio of the shaft 11 and that of the flange 12. Thereafter, the formed core is ground to a desired shape.

Preferably the metal magnetic material is a compact constituted by many alloy magnetic grains. Such compact is microscopically understood as an aggregate of many originally independent alloy magnetic grains bonded together, where individual alloy magnetic grains have oxide film formed at least partially around or preferably all around them and this oxide film ensures the insulation property of the compact. Adjacent alloy magnetic grains can constitute a compact having a certain shape primarily as a result of inter-bonding of the oxide films around the respective alloy magnetic grains. Adjacent alloy magnetic grains may be partially bonded together through their metal parts. Preferably the oxide film around the alloy magnetic grain is the result of oxidization of the alloy itself constituting the grain.

Preferably the alloy magnetic grain is constituted by a Fe—Si—M soft magnetic alloy. Here, M is a metal element that oxidizes more easily than Fe, and typically is Cr (chromium), Al (aluminum), Ti (titanium), etc., but preferably Cr or Al.

If the soft magnetic alloy is a Fe—Si—M alloy, preferably the remainder of Si and M is Fe except for the unavoidable impurities. Metals that may be contained other than Fe, Si and M include magnesium, calcium, titanium, manganese, cobalt, nickel and copper, and non-metals that may be contained include phosphorous, sulfur and carbon.

Preferably the metal magnetic material (compact) is manufactured by compacting the alloy magnetic grains and then applying heat treatment. At this time, preferably heat treatment is given in such a way that, in addition to the oxide films already present on the material alloy magnetic grains themselves, oxide films are also formed through oxidization of some of the parts that were in metal form on the material alloy magnetic grains. As mentioned, oxide film is the result of oxidization of the alloy magnetic grain primarily at its surface. In a favorable embodiment, the metal magnetic material does not contain oxides other than those resulting from the oxidization of the alloy magnetic grain, such as silica, phosphor compound, etc.

The individual alloy magnetic grains constituting the compact have oxide film formed around them. The oxide film may be formed in the material grain stage before the compact is formed, or it may be generated in the forming process by keeping oxide film nonexistent or minimal in the material grain stage. Presence of oxide film is recognized by a difference in contrast (brightness) on a scanning electron microscope (SEM) image of approx. 3000 magnifications. Presence of oxide film assures the insulation property of the metal magnetic material as a whole. It also suppresses deterioration, etc., due to temperature and humidity and reduces the environmental impact. This way, a reliable component that can be used at high temperature can be obtained.

In the metal magnetic material, bonding of alloy magnetic grains primarily takes the form of inter-bonding of oxide films. Presence of inter-bonding of oxide films can be clearly determined, for example, by visually recognizing on a SEM image magnified to approx. 3000 times, for example, that the oxide films of adjacent alloy magnetic grains have the same phase. Presence of inter-bonding of oxide films improves the mechanical strength and insulation property. Preferably the oxide films of adjacent alloy magnetic grains are bonded together throughout the compact, but the mechanical strength and insulation property will somewhat improve so long as some of them are bonded together, and this embodiment is also considered an embodiment of the present invention. Preferably the number of sites inter-bonded by oxide films is the same as or greater than the number of alloy magnetic grains contained in the compact. Also, as described later, the alloy magnetic grains may be partially inter-bonded together directly (metal-to-metal bonding, i.e., via inter-bonding of alloy magnetic grains without intervening oxide films) instead of via inter-bonding of oxide films. In addition, a pattern where the adjacent alloy magnetic grains are only physically in contact with or close to each other, instead of inter-bonding of oxide films or inter-bonding of alloy magnetic grains, may be seen in some areas. The "inter-bonding" refers to securely joining parts of materials together without any other intervening materials where a clear or discrete boundary between the materials is lost in some embodiments.

Methods to generate inter-bonding of oxide films include, for example, applying heat treatment at the specified temperature described later in an ambience of oxygen (such as in air) when the compact is manufactured.

In the metal magnetic material (compact), not only inter-bonding of oxide films, but also inter-bonding of alloy magnetic grains, may be present. As is the case of inter-bonding of oxide films mentioned above, inter-bonding of alloy magnetic grains can be clearly determined, for example, by visually recognizing on a SEM image magnified to approx. 3000 times, for example, that the adjacent alloy magnetic grains have a point of connection while maintaining the same phase. Presence of inter-bonding of alloy magnetic grains improves the magnetic permeability further.

Methods to generate inter-bonding of alloy magnetic grains include, for example, using material grains that have less oxide film formed on them, adjusting the temperature and partial oxygen pressure as described later for the heat treatment given to manufacture the compact, and adjusting the forming density when the compact is obtained from the material grains. For the heat treatment temperature, a level at which the alloy magnetic grains are bonded together but oxides do not generate easily can be proposed. A specific preferred temperature range is described later. As for the partial oxygen pressure, the partial oxygen pressure in air may be used, for example, and the lower the partial oxygen pressure, the less likely oxides are generated and the more likely the alloy magnetic grains are bonded together as a result.

The material grains may be grains manufactured by the atomization method, for example. As described above, preferably the compact contains bonds via oxide films and therefore preferably the material grains have oxide film present on them. Such material grains may be obtained by adopting any known method for manufacturing alloy grains, or by using commercial products such as PF-20F by Epson Atmix and SFR-FeSiAl by Nippon Atomized Metal Powders.

The method to obtain a compact from the material grains is not limited in any way, and any known means used in the field of grain compact manufacturing may be incorporated as deemed appropriate. A typical manufacturing method whereby the material grains are compacted without heating and then given heat treatment, is explained below. The present invention is not at all limited to this manufacturing method.

When the material grains are compacted without heating, preferably an organic resin is added as binder. For the organic resin, preferably one constituted by PVA resin, butyral resin, vinyl resin or other resin whose thermal decomposition temperature is 500° C. or below is used because less binder will be left after the heat treatment. Any known lubricant may be added during forming. Examples of lubricant include organic acid salts, and specifically zinc stearate and calcium stearate. The amount of lubricant is preferably 0 to 1.5 parts by weight, or more preferably 0.1 to 1.0 parts by weight, or even more preferably 0.15 to 0.45 part by weight, or most preferably 0.15 to 0.25 parts by weight, relative to 100 parts by weight of material grains. When the amount of lubricant is zero, it means no lubricant is used. After adding any binder and/or lubricant as desired, the material grains are agitated and then formed to a desired shape. This forming is done by applying 2 to 20 ton/cm$^2$ of pressure or adjusting the forming temperature to 20 to 120° C., for example. The fill ratio of the shaft 11 and that of the flange 12 are adjusted during forming by applying high pressure to the area 21 corresponding to the shaft, while applying low pressure to the area 22 corresponding to the flange, for example.

A preferred embodiment of heat treatment is explained.

Preferably heat treatment is performed in an oxidizing ambience. To be specific, the oxygen concentration during heating is preferably 1% or more, as this facilitates the generation of both inter-bonding of oxide films and inter-bonding of metals. While no upper limit of oxygen concentration is set in particular, the oxygen concentration in air (approx. 21%) may be used in consideration of manufacturing cost, etc. Preferably the heating temperature is 600° C. or above in order to facilitate oxide film generation and the generation of inter-bonding of oxide films, or 900° C. or below in order to suppress oxidization to an appropriate level and thereby increase the magnetic permeability while maintaining the presence of inter-bonding of metals. More preferably the heating temperature is 700 to 800° C. Preferably the heating time is 0.5 to 3 hours in order to facilitate the generation of both inter-bonding of oxide films and inter-bonding of metals. The mechanism by which the metal grains are bonded together via oxide films or directly is likely similar to the mechanism of so-called "ceramics sintering" in a high temperature range of 600° C. or above, for example. To be specific, it is important in this heat treatment, according to the new insight gained by the inventors of the present invention, that (A) the oxide films are exposed fully to an oxidizing ambience, while the metal elements are supplied from the alloy magnetic grains as necessary, to allow the oxide films to grow, and (B) the adjacent oxide films make direct contact with each other to mutually diffuse the substances constituting the oxide film. This means that preferably thermosetting resins, silicone and other substances that may remain in a high temperature range of 600° C. or above are virtually non-existent during heat treatment.

A coiled conductor is obtained by using such metal magnetic material as a core and winding an insulated, sheathed conductive wire around its shaft 11. Also, a terminal electrode is formed on its flange 12. The terminal electrode electrically connects to an end of the coiled conductor and can be used as a point of connection with the outside of the electronic component proposed by the present invention. The form of the terminal electrode and how it is manufactured are not limited in any way, and it is preferably formed by means of plating and more preferably contains Ag, Ni and Sn. For example, Ag paste is applied on the flange 12 and then baked to form the base, after which Ni/Sn plating is applied and solder paste is applied on top, and then the solder is melted and the end of the coiled conductor is embedded to electrically connect the windings and the terminal electrode. For the means to obtain the electronic component from the metal magnetic material, any known manufacturing method in the field of electronic components may be incorporated as deemed appropriate.

Figure 6:
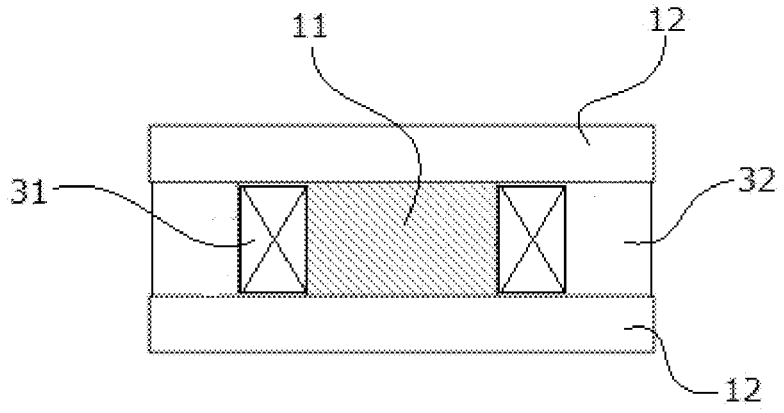
FIG. 6 is a schematic cross sectional view of an electronic component according to an embodiment of the present invention.

Preferably an exterior member (e.g., an exterior member 32 in FIG. 6) is provided on the outside of the coiled conductor (e.g., a coil conductor 31 in FIG. 6). Preferably the exterior member contains an organic resin and metal magnetic material. Presence of the exterior member improves the shieldability of magnetic flux. Accordingly, it is important that power supply circuits, which are vulnerable to the negative effect of magnetic flux leakage, have this exterior member. The exterior member is formed by, for example, using a dispenser to apply epoxy resin containing magnetic material onto the interior face of the core flange, in several steps, to cover the windings with the resin and then curing the resin with heat. The metal magnetic material for the exterior member may be the same as or different from the metal magnetic material for the shaft 11 and flange 12, where examples include alloy systems such as Fe—Si—Cr, Fe—Si—Al and Fe—Ni, amorphous systems such as Fe—Si—Cr—B—C, Fe—Si—B—C and Fe, and materials produced by mixing the foregoing, and where preferably the average grain size is 2 to 30 μm and preferably the weight ratio of the metal magnetic material to the exterior member is 50 to 96 percent by weight. The organic resin for the exterior member is not limited in any way and examples include, but are not limited to, epoxy resin, phenol resin and polyester resin.

EXAMPLES

The present invention is explained more specifically using examples. It should be noted, however, that the present invention is not at all limited to the embodiments described in these examples.

A power inductor was manufactured as described below.

Core size: Drum core of 1.6×1.0×1.0 mm

Flange thickness: 0.25 mm

Shaft diameter: Ø0.5 mm (ground core)

Windings: Ø0.1 mm

Number of turns: 3.5

Terminal electrode: Ag paste, Ni plating, Sn plating

Exterior resin: Epoxy resin 10 percent by weight, magnetic material 90 percent by weight One hundred parts by weight of the alloy magnetic grains having the grain size (D50) shown in Table 1 were mixed under agitation with 1.5 parts by weight of PVA binder whose thermal decomposition temperature is 300° C., and 0.2 parts by weight of zinc stearate was added as lubricant. Next, the grains were filled in the dies for shafts and those for flanges according to the specified densities, respectively, and the densities were adjusted by adjusting the compacting amounts. The dies were operated by changing the fill ratio of alloy magnetic grains between the shaft and flange to compact the grains, which were then heat-treated for 1 hour at 750° C. in an oxidizing ambience of 21% in oxygen concentration, to obtain a grain compact. Almost no contraction occurred during the heat treatment and, by setting the compacting densities, a core with varying densities could be obtained with ease. The terminal electrode was formed on the flange. Ag paste was applied on the flange and then baked to form the base, after which Ni/Sn plating was applied and then solder paste was applied on top. Next, a sheathed copper wire was wound around the outer periphery of the shaft to obtain a coiled conductor. Thereafter, the solder at the terminal electrode was melted and both ends of individual windings were embedded to connect the windings and the terminal electrode. Also, an exterior member was formed thereafter. The magnetic material for the exterior member was produced by mixing an amorphous material with a D50 of 20 μm (FeSiCrBC) with an amorphous material with a D50 of 5 μm (FeSiCrBC) at a weight ratio of 75:25. Using a dispenser, epoxy resin containing this magnetic material was applied on the interior face of the flange, in several steps, to cover the windings with the resin. Thereafter, the resin was cured with heat to obtain an exterior member.

(Evaluation)

Evaluation of fill ratio: Flange and shaft samples of necessary volumes were collected and measured for density according to the fixed-volume expansion method. With the samples collected, the density ratio corresponds to the fill ratio because the flange and shaft were made of the same material.

Evaluation of plating property: An " ×" was given when the electrode length from the end (dimension e) became 0.35 mm or more compared to the initial 0.3 mm, and an "○" was given when the foregoing was not the case.

Evaluation of inductance: Samples having 3.5 t windings were measured at 1 MHz using a LCR meter (4285).

Table 1 summarizes the manufacturing conditions and measured results of the respective samples. In the table, Fe—Si—Cr represents a material manufactured according to the atomization method and having a composition of Cr constituting 4.5 percent by weight, Si constituting 3.5 percent by weight, and Fe constituting the remainder, in which presence of bonds via oxide films were confirmed on a SEM image. Fe—Si—Al represents a material manufactured according to the atomization method and having a composition of Al constituting 5.5 percent by weight, Si constituting 9.7 percent by weight, and Fe constituting the remainder, in which presence of bonds via oxide films were confirmed on a SEM image of 3000 magnifications.

TABLE 1

| Material | Grain size D50 [μm] | Core density Flange a [g/cm$^3$] | Shaft b [g/cm$^3$] | Density ratio a/b | Acceptability of plating property | Inductance [μH] |
|---|---|---|---|---|---|---|
| Fe-Si-Cr | 15 | 6.70 | 6.70 | 1.00 | x | 0.91 |
| | | 6.58 | 6.81 | 0.97 | ○ | 0.91 |
| | 10 | 6.55 | 6.55 | 1.00 | x | 0.81 |
| | | 6.44 | 6.64 | 0.97 | ○ | 0.81 |
| | | 6.39 | 6.73 | 0.95 | ○ | 0.83 |
| | | 6.20 | 6.90 | 0.90 | ○ | 0.82 |
| | 6 | 6.35 | 6.35 | 1.00 | x | 0.78 |
| | | 6.25 | 6.44 | 0.97 | ○ | 0.78 |
| | | 6.20 | 6.55 | 0.95 | ○ | 0.80 |
| | | 6.03 | 6.68 | 0.90 | ○ | 0.79 |
| | 2 | 6.10 | 6.10 | 1.00 | x | 0.72 |
| | | 6.01 | 6.20 | 0.97 | ○ | 0.72 |
| | | 5.95 | 6.28 | 0.95 | ○ | 0.74 |
| Fe-Si-Al | 6 | 6.38 | 6.38 | 1.00 | x | 0.80 |
| | | 6.28 | 6.47 | 0.97 | ○ | 0.80 |
| | | 6.21 | 6.57 | 0.95 | ○ | 0.82 |

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, an article "a" or "an" may refer to a species or a genus including multiple species, and "the invention" or "the present invention" may refer to at least one of the embodiments or aspects explicitly, necessarily, or inherently disclosed herein. In this disclosure, any defined meanings do not necessarily exclude ordinary and customary meanings in some embodiments.

The present application claims priority to Japanese Patent Application No. 2013-159977, filed Jul. 31, 2013, the disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. An electronic component comprising:

a shaft;

a flange formed at an end of the shaft and constituting a core together with the shaft;

a coiled conductor wound around the shaft; and an electrode terminal formed on the flange and connected electrically to an end of the coiled conductor;

wherein the shaft and flange are made of a metal magnetic material, and the shaft is more densely filled with the metal magnetic material than the flange, wherein a/b, where a represents a fill ratio of metal magnetic material of the flange and b represents a fill ratio of metal magnetic material of the shaft, is 0.9 to 0.97.

2. An electronic component according to claim 1, wherein the core is either a drum core or T core.

3. An electronic component according to claim 1, wherein the metal magnetic material is constituted by an aggregate of many alloy magnetic grains and adjacent alloy magnetic grains are aggregated with each another primarily by inter-bonding of oxide films formed near surfaces of the grains.

4. An electronic component according to claim 3, wherein the oxide films are constituted solely by an oxide of the alloy magnetic grains.

5. An electronic component according to claim 1, wherein an exterior member is further provided on an outside of the coiled conductor, the exterior member contains an organic resin and metal magnetic material, and the metal magnetic material contained in the exterior member is the same as or different from the metal magnetic material constituting the shaft and flange.

6. An electronic component according to claim 1, wherein the electrode terminal contains Ag, Ni, and Sn.

7. An electronic component according to claim 1, wherein the core includes no ferrite material.

8. An electronic component according to claim 1, wherein the metal magnetic material is constituted by a Fe—Si—M soft magnetic alloy where M is a metal element that oxidizes more easily than Fe.

9. An electronic component according to claim 1, wherein the shaft and the flange are simultaneously heat-treated.

10. An electronic component according to claim 1, wherein a thickness of the flange is 0.25 mm or less.

* * * * *